US007043887B2

(12) United States Patent
Van Ootmarsum

(10) Patent No.: US 7,043,887 B2
(45) Date of Patent: May 16, 2006

(54) PRE-ISOLATED STORAGE TANK FOR COLD LIQUIDS

(75) Inventor: Harry Robert Van Ootmarsum, Goirle (NL)

(73) Assignee: Insulation Consulting & Procurement Services Holding, B.V. (NL)

( * ) Notice: Subject to any disclaimer, the term of this patent is extended or adjusted under 35 U.S.C. 154(b) by 0 days.

(21) Appl. No.: 10/398,496

(22) PCT Filed: Oct. 2, 2001

(86) PCT No.: PCT/NL01/00725

§ 371 (c)(1),
(2), (4) Date: Jul. 31, 2003

(87) PCT Pub. No.: WO02/29310

PCT Pub. Date: Apr. 11, 2002

(65) Prior Publication Data

US 2004/0040237 A1 Mar. 4, 2004

(30) Foreign Application Priority Data

Oct. 4, 2000 (NL) ..... 1016327

(51) Int. Cl.
*E04C 1/00* (2006.01)
*E04B 1/16* (2006.01)
*E04B 1/92* (2006.01)

(52) U.S. Cl. ..... 52/741.4; 52/168; 52/381; 52/309.12

(58) Field of Classification Search ..... 52/168, 52/169.14, 741.4, 741.41, 381, 382, 414, 52/309.12, 309.17, 796.1, 515, 506.01, 319, 52/334

See application file for complete search history.

(56) References Cited

U.S. PATENT DOCUMENTS

| | | | | |
|---|---|---|---|---|
| 3,136,135 | A * | 6/1964 | Rigby et al. | 405/53 |
| 3,151,416 | A * | 10/1964 | Eakin et al. | 52/741.12 |
| 3,468,771 | A * | 9/1969 | Pedlow | 52/309.12 |
| 3,562,977 | A * | 2/1971 | Alleaume | 52/249 |
| 3,633,328 | A * | 1/1972 | Closner et al. | 52/169.1 |
| 3,648,879 | A * | 3/1972 | Jackson | 220/560.08 |
| 3,669,815 | A * | 6/1972 | Desai et al. | 52/309.11 |
| 3,791,912 | A * | 2/1974 | Allard | 428/159 |
| 3,953,629 | A * | 4/1976 | Wesch | 52/309.17 |
| 4,041,722 | A * | 8/1977 | Terlesky et al. | 52/246 |

(Continued)

FOREIGN PATENT DOCUMENTS

| | | | |
|---|---|---|---|
| DE | 4032769 | A | 5/1991 |
| FR | 2627791 | A1 * | 9/1989 |

*Primary Examiner*—Peter M. Cuomo
*Assistant Examiner*—Sarah B. McPartlin
(74) *Attorney, Agent, or Firm*—Todd Deveau; Thomas, Kayden, Horstemeyer & Risley LLP

(57) ABSTRACT

A storage tank (100) with a pre-insulated outer tank (110) has been described, and a method for building such. For building a wall (112) of an outertank (110), a formwork (90) is erected with an inner partition (92) to which PVC-foam plates (10) have been attached, which at their inner surface (2) are provided with a coating (3) provided with gravel (4). Subsequently, concrete (94) is poured into the inner formwork space (93), which concrete attaches firmly to the gravel sticking out of the coating. On a floor (111), a coating layer (121) is applied, over which a layer of PVC-foam plates (122) is applied. Subsequently, a secondary monolithic coating layer (123) is sprayed over those PVC-foam plates (122) and onto the inner surface of the coated PVC-plates 10 of the wall (112).

13 Claims, 7 Drawing Sheets

Figure 1:
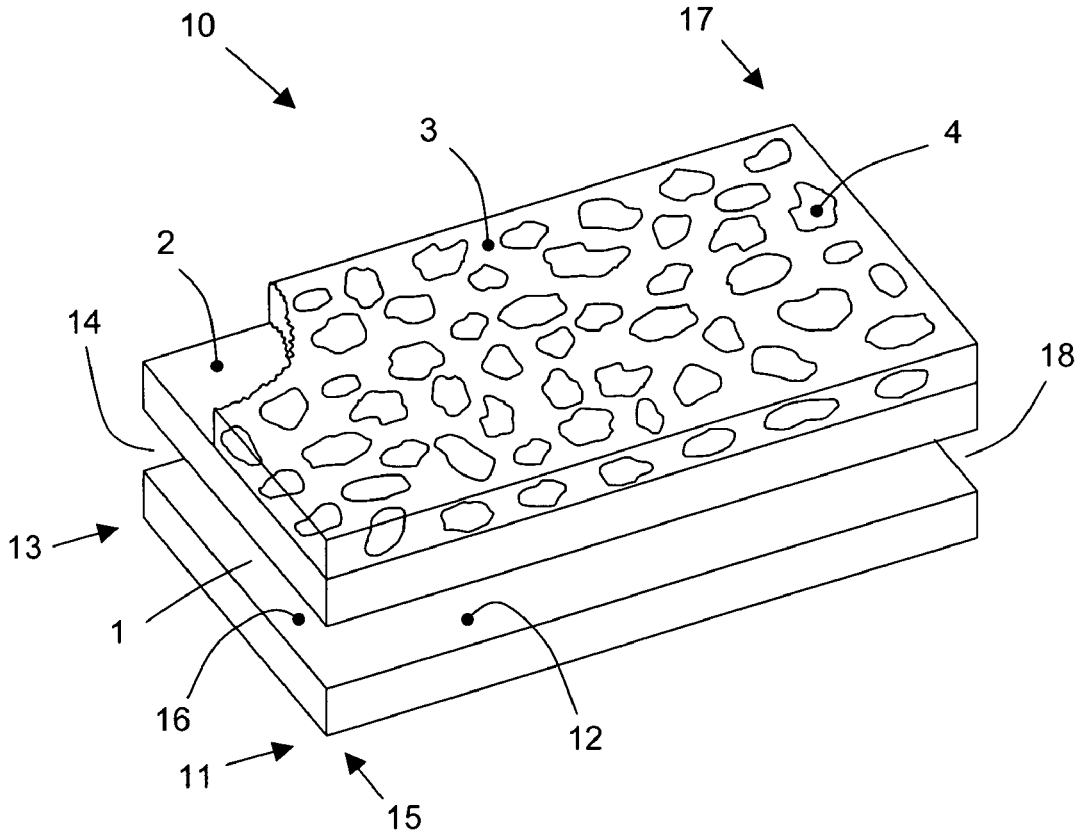

U.S. PATENT DOCUMENTS 4,053,677 A * 10/1977 Corao ..... 52/309.12
4,069,642 A 1/1978 Hendricks
4,117,947 A * 10/1978 Androulakis ..... 52/249
4,128,981 A * 12/1978 Juba ..... 52/309.17
4,221,619 A 9/1980 Lemonds
4,292,364 A * 9/1981 Wesch et al. ..... 52/309.17
4,349,398 A * 9/1982 Kearns et al. ..... 52/309.12
4,464,081 A * 8/1984 Hillier et al. ..... 405/53
4,513,550 A 4/1985 Kotcharian
4,775,567 A * 10/1988 Harkness ..... 52/169.14
5,157,888 A * 10/1992 Lindquist ..... 52/745.01
5,545,450 A * 8/1996 Andersen et al. ..... 428/313.9
5,562,586 A * 10/1996 Hyde-Smith ..... 405/129.7
5,928,803 A * 7/1999 Yasuda ..... 428/315.9
6,468,643 B1 * 10/2002 Kanbayashi et al. ..... 428/293.7

* cited by examiner

PRE-ISOLATED STORAGE TANK FOR COLD LIQUIDS

RELATED APPLICATION

This application claims priority to and the benefit of NL1016327 filed Oct. 4, 2000.

The present invention relates in general to the storage of cold liquids in a large storage tank. In the context of the present invention, the expression "cold liquids" shall mean substances which are liquid at temperatures in the range of 0° C. to −200° C. More particularly, the present invention relates to the storage of substances which are liquid in the temperature range between −5° C. and −196° C., wherein the storage takes place under atmospheric pressure. For storage tanks of this type, a Euro-norm applies, indicated as "atmospheric, refrigerated, liquified gas storage tanks with operating temperatures between −5° C. and −196° C." Such tanks are fixedly positioned at a storage location, either above bottom surface or sunken completely in the bottom. Horizontal dimensions of such tanks are typically within the range of 10 meters to 100 meters, and the height can typically be up till 50 meter.

Tanks for the storage of such cold liquids have to meet a number of design requirements. The constructive strength should be large enough to carry the weight of the liquid. The tank should be liquid-tight, vapor-tight, and should. fulfill an isolating function between the cold liquid in the interior and the surroundings. Finally, provisions must be made to prevent that the tank immediately empties towards the surroundings in the unlikely event of a leakage.

Such tanks are known per se. By way of example, reference is made to European patent 0.022.384 and French patent publication 2.739.675.

Up till now, such tanks are built according to a concept wherein said functions are fulfilled by different components. A metal storage tank or inner tank is placed in an outer tank, which usually is made of armored concrete. At its inner surface, the concrete outer tank is provided with a metal membrane which fulfills the function of vapor-tight and liquid-tight barrier, and the space between the inner tank and the outer tank is filled with an insulation material.

When building such a tank, first the outer tank is built. When the concrete walls of the outer tank are finished, carbon-steel plates are arranged at the inner side thereof, which must be welded to each other in a liquid-tight manner. On the bottom of the outer tank, an insulation layer is arranged for the bottom and a part of the wall for protection of the corners. This insulation usually is in the form of cellular glass, which material only reaches the desired pressure-resistance with special bitumen-products. After that, additional layers are applied to obtain the desired insulation value, after which a ring beam and an inner tank are built on this bottom insulation. Eventually, the inner tank is the tank in which the liquid is stored. To increase the safety in the unlikely event of the occurrence of a leak in the inner tank, whereby the liquid could flow out of the inner tank and the outer tank could be damaged, a protective layer is applied ("secondary liner") in the form of metal plates of invar or 9% nickel steel, which are arranged on the bottom insulation and against at least an insulated lower part of the wall of the outer tank. These steel plates must be made to measure on location and must be welded to each other and to the inner tank in a liquid-tight manner.

Then, insulation material is arranged in the space between the wall of the inner tank and the wall of the outer tank usually by pouring perlite grains.

Thus, building such tank according to the state of the art is very labor-intensive. Herein it is a disadvantage that the applying of several kinds of insulation material and sealing material at several locations must be done at strongly different moments in time, while furthermore those activities often lie on the critical work path, i.e. subsequent activities must wait until previous activities have been completed.

During use, especially the inner tank will experience volume variations as result of thermal contraction and expansion. This has as a consequence that the dimensions of the annular space between the inner tank and the outer tank vary, causing the conventionally used perlite grains to tend to settle themselves, i.e. the height of the perlite bulk decreases. In order to maintain the desired insulation value, therefore, perlite must regularly be filled.

An important aim of the present invention is to take away said disadvantages.

More particularly, the present invention aims to provide a design and building method for a storage tank for cold liquids, wherein a substantial saving on building time and building cost can be achieved, while maintaining or perhaps even improving the insulation properties and the sealing properties.

According to an important aspect of the present invention, for providing the insulation, use is made of insulation blocks which are made of PVC-foam, and which are placed in the formwork before the concrete of the tank walls is poured. After the concrete has hardened, the wall of the outer tank is already sufficiently insulated. Preferably, the plates of PVC-foam are provided with a vapor-tight coating, so that the subsequent applying of a vapor-tight liner is also not necessary anymore.

It is noted that there are already storage tanks of which the wall of an outer tank is provided with a vapor-tight coating on the basis of epoxy. Such a system is very disadvantageous. In the first place the use of epoxy requires a very accurate regulation of the ambient conditions, since inter alia temperature and air humidity are very critical. In the second place, toxic fumes are released when applying epoxy, which means that the personnel concerned must be enveloped in protective suits, and that no other activities are possible in the tank during the applying of epoxy. According to the present invention, use is made of a two-component material which is applied as a spray product and which forms therein a monolithic layer. The two-component material is mixed in a spray nozzle, after which the two components engage into a chemical reaction with each other which is finished after approximately two minutes, wherein the coating has grown hard. Hereby, it is relatively easily possible to apply a larger thickness within a shorter amount of time.

Figure 2A:
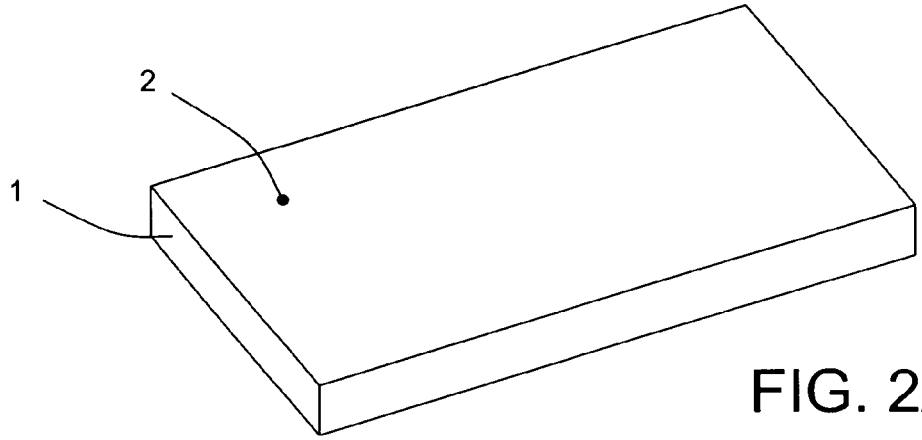
Figure 2B:
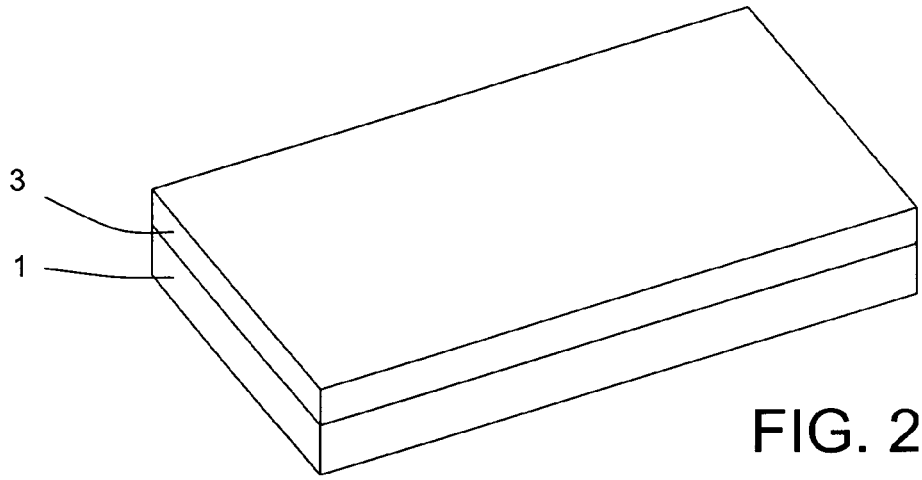
Figure 2C:
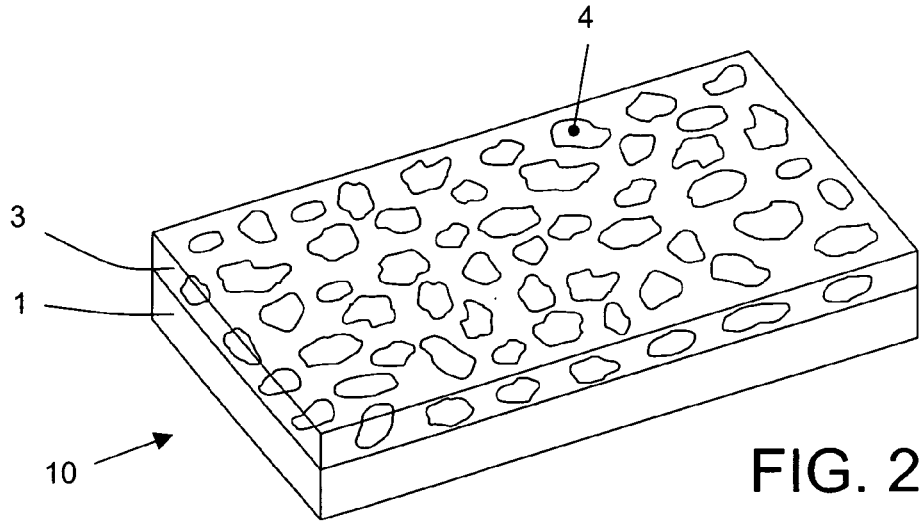
Figure 3A:
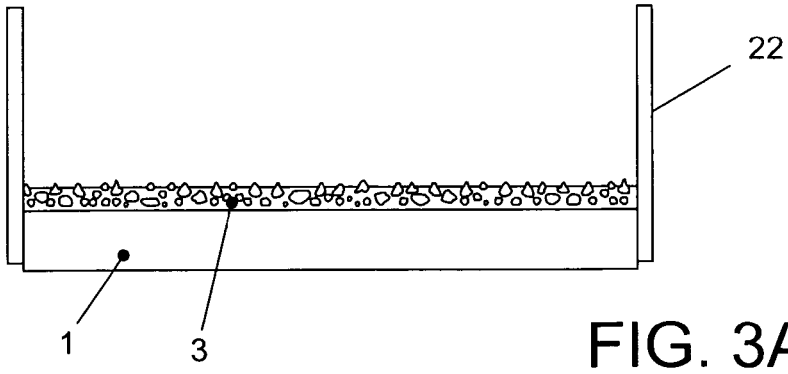
Figure 3B:
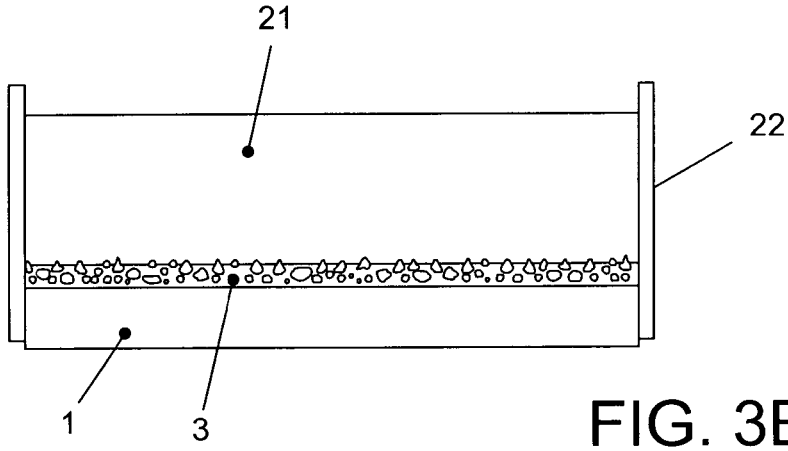
Figure 3C:
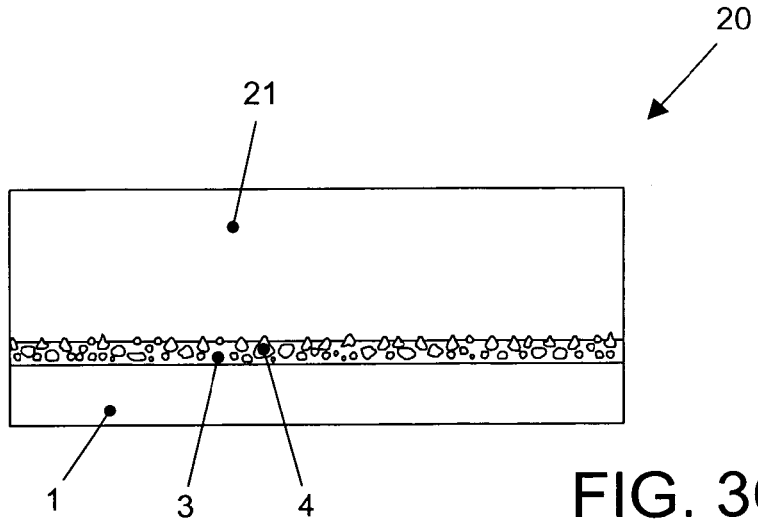
Figure 4A:
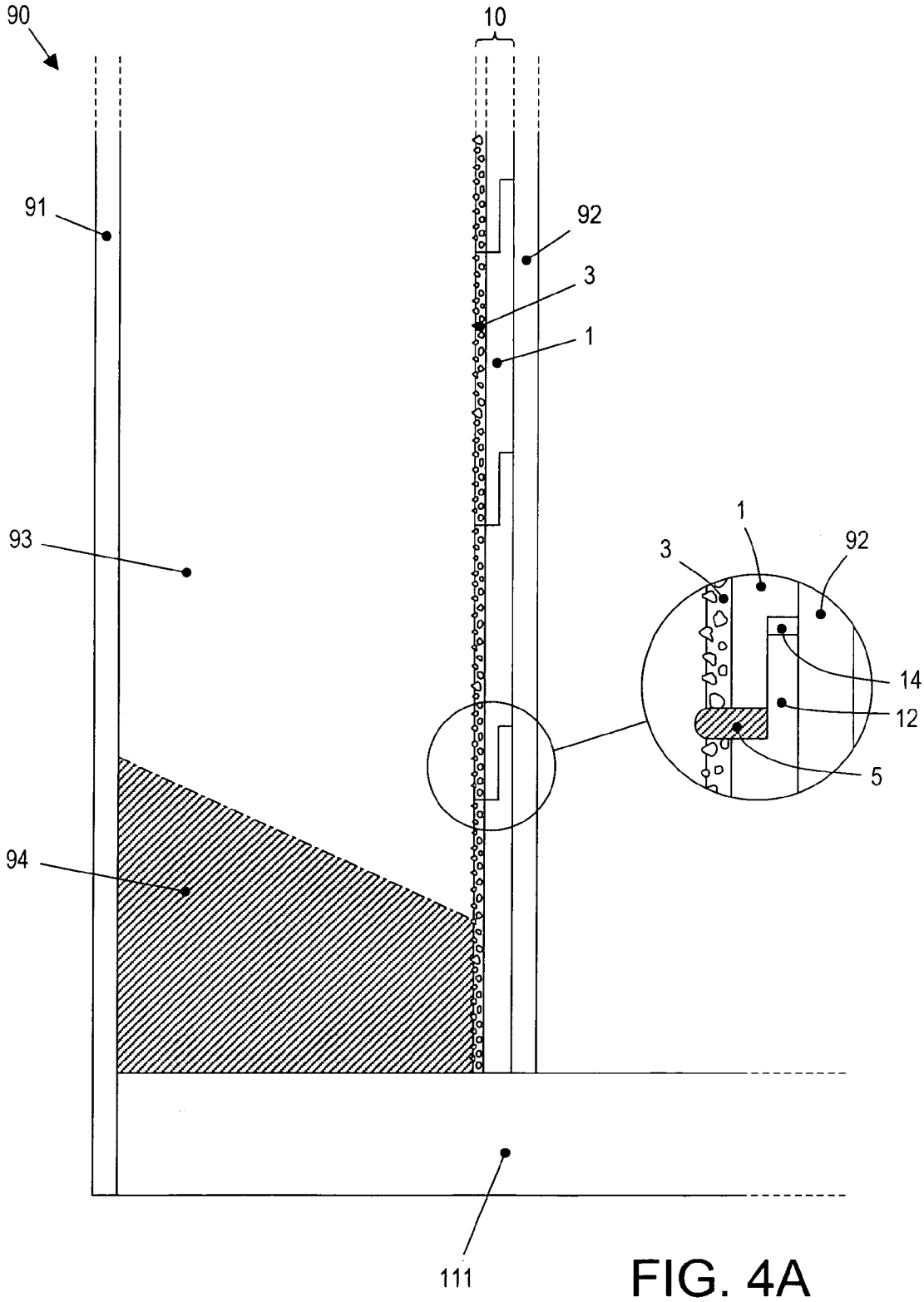
Figure 4B:
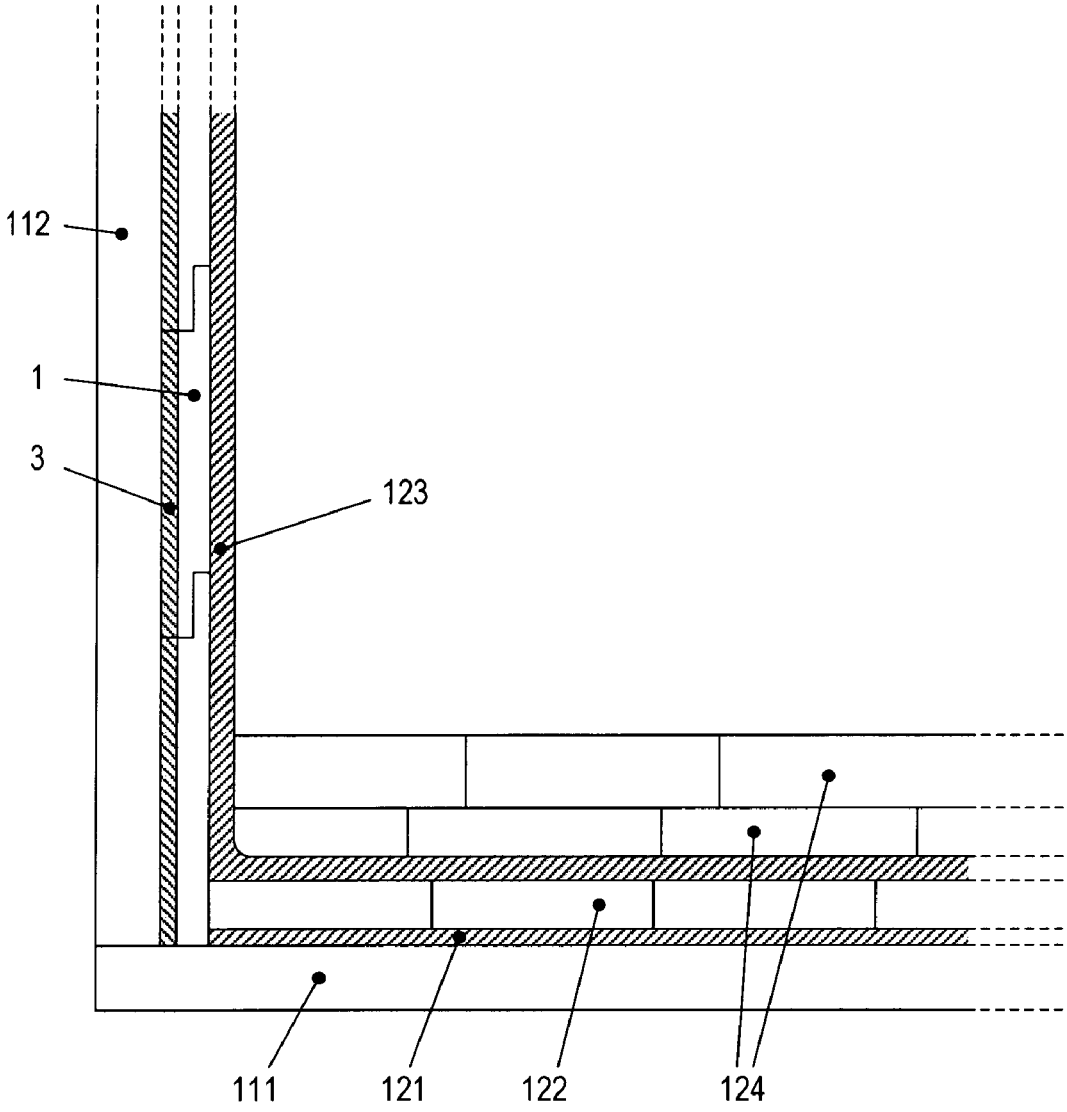
Figure 5:
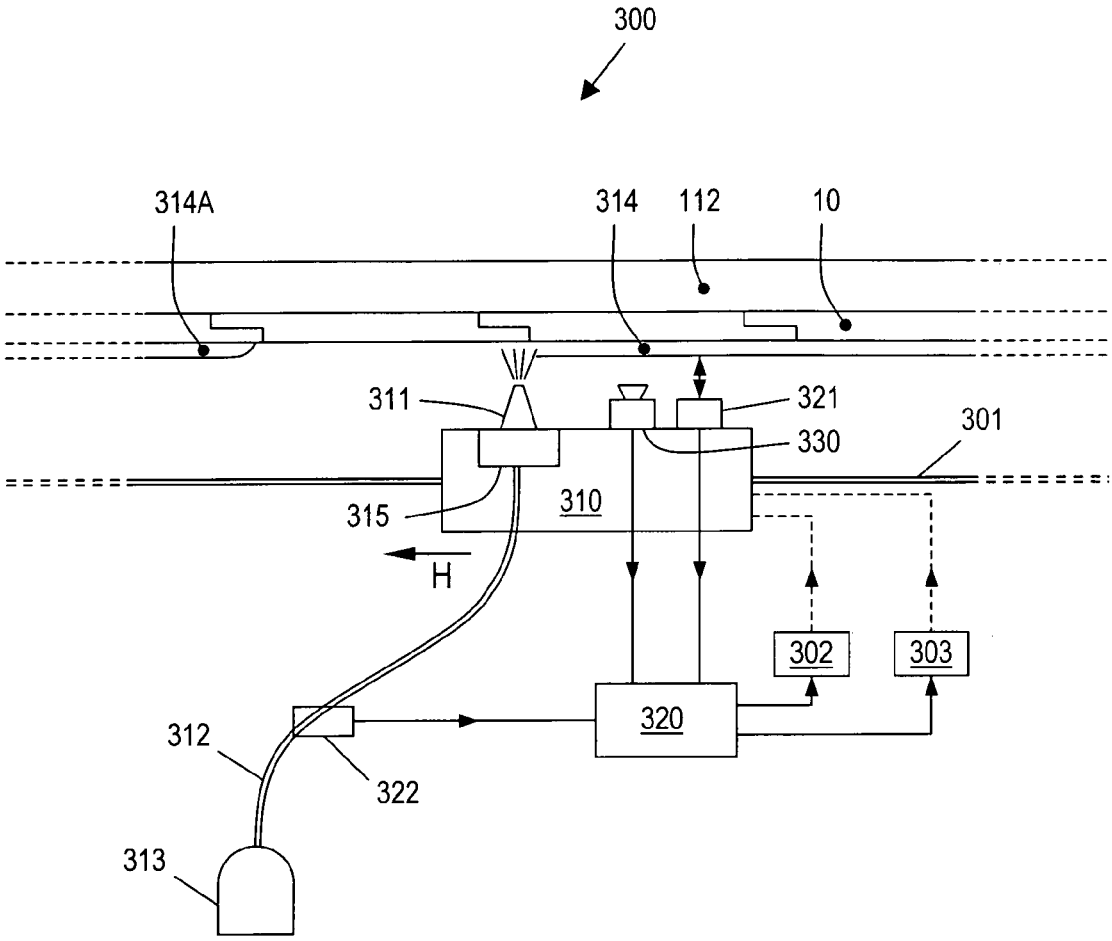

These and other aspects, features and advantages of the present invention will be further clarified by the following description with reference to the drawings, in which same reference numerals indicate same or similar parts, and in which:

FIG. 1 schematically shows a perspective view of an isolation plate member according to the present invention, with partially broken-away coating;

The FIGS. 2A–2C illustrate several stages of a manufacturing process for the isolation plate of FIG. 1;

The FIGS. 3A–3C illustrate several stages of a manufacturing process for insulated concrete construction element;

The FIGS. 4A–B illustrate several stages of a building process for building a storage tank;

And FIG. 5 illustrates applying a coating in a storage tank.

FIG. 1 schematically shows a perspective view of an isolation plate member 10 according to the present invention, and the FIGS. 2A–2C illustrate several stages of a manufacturing process for this isolation plate 10. Starting material is a plate of PVC-foam 1, which in principle can have any desired dimension, but a suitable standard measure is for instance 1×2 $m^2$. The thickness of the plate PVC-foam 1 can be chosen by a skilled person at a desired value; a suitable value for this thickness is in the range of approximately 4 cm to approximately 10 cm, for instance approximately 7.5 cm. Since PVC-foam is a known per se material, this expression will not be further explained here. Normally, PVC-plates are manufactured in thicknesses up till 75 mm; larger thicknesses can be achieved by industrially gluing together multiple plates onto each other.

The plate PVC-foam 1 has a main surface 2, onto which a layer is applied of a two-component polymer material 3. This coating material has been developed to fit well to the PVC-foam, properties-wise, and to be also liquid-tight and vapor-tight. More particularly, the coating 3 has been chosen to adhere well to the PVC-foam and to have a comparable contraction coefficient, such that, on variations in temperature, the coating and the foam will contract or expand to a similar extent. A material which has proven itself in experiments, is commercially available under the brand name IWR ESATEC HR 1000 from the company TAGOS S.r.L. in Sumirago, Italy; on the market, this material is also known under the name IWR CRYOCOAT HR, and is commercially available under this name from the company INSU-W-RAPID B.V. in Tilburg, the Netherlands. The coating material is sprayed by means of a mix/spray head, and the components immediately undergo a chemical reaction which is finished after approximately 2 minutes.

When spraying, one can adjust the thickness of the layer at choice. A value of 2 mm for the thickness of the coating 3 has proven itself in experiments, but if desired, one can also apply thinner or thicker coating thicknesses. In the figures, the thickness of the coating 3 is shown in a strongly exaggerated manner.

If desired, one can provide multiple surfaces of the PVC-foam plate 1 with such a coating layer 3; for most applications it suffices if the coating 3 is applied on one main surface 2.

A PVC-foam plate 1 which is thus provided with a coating 3 already forms an inventive insulation product according to the present invention, and is useful for constructing a storage tank according to the present invention. A special embodiment of the isolation plate 10, which is especially suitable to be used in combination with concrete, is schematically illustrated in FIG. 2C. Immediately after spraying of the coating 3 (FIG. 2B), gravel is scattered onto the still wet coating, schematically indicated at 4. In this context, gravel is understood as: either or not regular lumps of stone, rubble or grit, or a stone-like material such as concrete, of which the dimensions mostly typically lie in the range of about 0.5 mm to about 5 mm.

In the FIGS. 2A–C, the PVC-foam plate 1 is shown as a rectangular block. In the preferred embodiment illustrated in FIG. 1, the PVC-foam plate 1 has a stepped profile. More particularly, the isolation plate 10 has a projecting foot part 12 at a first long side edge 11, while a recess 14 is present at the opposite side edge 13. The dimensions of the recess 14 correspond to those of the foot 12, so that, if multiple isolation plates 10 are arranged next to each other, the foot of one isolation plate always fits into the recess of an adjacent isolation plate. Likewise, the isolation plate 10 has a projecting foot part 16 at a first short side edge 15, while a fitting recess 18 is present at the opposite side edge 17.

In FIG. 1, the PVC-foam plate 1 is shown as an integral whole, including the feet 12 and 16 and the recesses 14 and 18. Preferably, however, the PVC-foam plate 1 is formed by fixing, for instance gluing, two (or more) rectangular base plates onto each other, one base plate being displaced with respect to the other in order to form said feet and recesses.

The isolation plate 10 proposed by the present invention in particularly suitable to be used in combination with concrete, because the gravel 4 in the coating 3 makes possible a very good bond between the isolation plate 10 and the concrete. Therefore, the present invention proposes an insulated concrete construction element 20, comprising a concrete body 21 with an isolation plate 10 against it, the coating 3 of this isolation plate 10 which is provided with gravel being directed towards the concrete body 21 and being fixedly attached thereto.

Manufacturing such an insulated concrete construction element 20 can take place by firstly manufacturing an isolation plate 10 of the desired dimensions, and subsequently placing this isolation plate 10 on the bottom of a mould or formwork or against the wall of a mould or formwork. Because of the constructive strength, the isolation plate 10 can also be used itself as wall or, as shown in FIG. 3A, as bottom of a formwork 22. The coating 3 provided with gravel of this isolation plate 10 should always be directed towards the interior of this mould/formwork 22.

Subsequently, concrete 21 is poured into this mould/formwork 22 (FIG. 3B). The wet concrete will attach well to the coating 3 provided with gravel 4 of the isolation plate 10. Herein, it plays a role that the free surface of the coating 3 is relatively rough by the presence of the gravel 4, and that many of the gravel grains 4 partly stick out of the coating, i.e. are not covered with coating material, so that the concrete 21 can engage directly onto these gravel grains.

After hardening of the concrete 21, the insulated concrete construction element 20 is finished, and can be removed from the mould/formwork 22 (FIG. 3C). Particularly, no separate action is necessary for fixing isolation plate 10 to the concrete body 21, such as gluing, screwing, etc.

Otherwise, it is noted that the plate 10 does not need to be a flat plate but may have a certain desired contour; the same applies to the construction element 20.

FIG. 4A schematically illustrates some faces of a building process for building a storage tank 100. First, the concrete floor 111 of an outer tank 110 is laid on a suitable foundation. If the floor 111 has hardened to a sufficient extent, a formwork 90 for the cylindrical wall 112 of the outer tank 110 is built. The formwork 90 comprises an outer partition 91 and an inner partition 92, which have been placed at a mutual radial distance with respect to each other and thus define an inner formwork space 93. Isolation plates 10 are attached to the inner partition 92, which isolation plates 10 have the preferred embodiment described above, i.e. they are provided with a coating layer 3 in which gravel 4 is applied. The coating layer of the isolation plate 10 is located at the side directed away from the partition 92, i.e. at the side of the outer partition 91. Thus, this coating layer 3 forms a wall surface of the inner formwork space 93. Adjacent isolation plates 10 engage into each other with respective feet 12 and recesses 14, such as discussed in the above. Possible seams between adjacent isolation plates 10 are filled with a suitable cement 5, for instance a known per se butyl cement, in order to effect a liquid-tight and vapor-tight sealing between the isolation plates 10 adjacent to each other.

After the inner partition 92 has been thus provided with isolation plates 10 over the entire circumference and up till a suitable height, a reinforcement not shown for the sake of simplicity is placed in the remaining inner space 93, after which this inner space 93 is poured full with concrete 94. This concrete 94 attaches very well to the coating 3 of the isolation plates 10, which attachment is further improved by the presence of the gravel 4 projecting out of the coating layer 3.

When the formwork 90 is now removed after the concrete 94 has hardened sufficiently, a wall 112 results which at its inner side is provided with a vapor-tight isolation structure. Herein, the thermal insulation is provided by the PVC-foam 1, while the vapor-tight barrier is formed by the coating 3. Therefore, the application of metal plates or the like for making a vapor-tight barrier is not necessary anymore.

An important advantage achieved herein is that, when attaching the insulation layer 10 to the concrete, no separate pretreatment is necessary, such as for instance arranging attachment points in the hardened concrete. Positioning the insulation plates within the formwork 90 is relatively simple, while the attachment of the insulation plates 10 to the concrete 94 takes place automatically. In the building process according to the state of the art, several actions must be taken after hardening of the concrete before the insulation and vapor-tight barrier of the wall 112 is a fact; in the building method proposed by the present invention, the insulation of the wall 112 is a fact directly after the concrete of the wall 112 has hardened. Thus, a substantial saving in building time is achieved.

In order to facilitate applying the insulation plates 10 to the inner partition 92, the inner partition 92 is preferably placed first, and the insulation plates 10 are attached to that; after that, the outer partition 91 is placed. In principle, it is possible to build the formwork 90 up till the full height of the wall 12 to be built. It is, however, preferred to implement the formwork 90 as sliding formwork. Herein, always an annular section of the wall 112 is manufactured, after which the formwork is placed higher in order to manufacture a higher annular section of the wall 112. Prior to the pouring of the concrete, a new insulation plate 10 can be attached to its lower neighbor at its lower edge, for instance by means of said cement 5, or by means of a screw or the like. At its upper edge, this new insulation plate 10 can temporarily be attached to the inner partition 92 by means of for instance an L-shaped screw hook or the like. Then, the concrete 94 for the new annular section of the wall 112 is poured, wherein the upper edge of the uppermost insulation plate 10 is left free. After hardening of the concrete 94, said screw hook or the like is taken away; the inner partition 92 can now be disengaged, wherein the uppermost insulation plate 10 is held by the concrete. Now, a next annular section of the wall 112 can be manufactured.

A next step in the building process is applying an insulation layer onto the floor 111. First, a coating layer 121, of the same material as discussed in the above in conjunction with the coating of the insulation plates 10, is applied onto the upper face of the floor 111 (FIG. 4B). Application of the coating 121 is again effected by means of spraying, up till a suitable thickness in the order of for example 2 to 6 mm. The main task of this coating layer 121 is to form a vapor-tight barrier towards the floor 111.

Subsequently, a layer of PVC-foam plates 122 is placed on the thus coated floor 111. These PVC-foam plates can be identical to the coated foam plates 10 discussed earlier, but this is not necessary: more particularly, the PVC-foam plates 122 may be non-coated straight blocks with suitably chosen length and width dimensions, for instance in the order of 1 to 2 m, and with a thickness of about 75 mm.

As already mentioned, the storage tank 100 eventually comprises an inner tank 120 in which the cold liquid is stored. In case of a leakage in this inner tank 120, the cold liquid flows out of the inner tank: for such a calamity, the outer tank 110 should be designed suitably to be able to keep this cold liquid during a predetermined time in a reliable manner without leaking. A critical point herein is the connection of the wall 112 to the bottom 111. According to the building method according to the state of the art, wherein a vapor-tight and liquid-tight lining of metal plates is applied, particular care must be paid to the connection of those metal plates in the corning area. According to the present invention, the combination of floor 111 and wall 112 is formed into a reliable liquid-tight basin by applying one secondary monolithic coating layer 123 onto the floor 111 and the wall 112. More particularly, this secondary monolithic coating layer 123 is applied on the said plates of PVC-foam 122 and onto the inner surface of the coated PVC-plates 10 of the wall 112. Here, too, application is effected by means of spraying. The thickness of this secondary coating layer 123 preferably is larger than 3 mm.

The secondary coating layer 123 can be applied over the full height of the wall 122, but this is not necessary. It will be clear to a person skilled in the art that it can be calculated how high the liquid level will be in the outer tank 110 in the unlikely event that the inner tank 120 drains entirely; it is sufficient that the coating layer 123 against the wall 112 reaches up to that expected level.

For improvement of the insulation value of the bottom 11, one or more layers of PVC plates 124 may subsequently be arranged over each other, comparable to the said PVC-plates 22, until a total thickness is achieved which depends on the insulation value desired, and which by way of example may be in the order of about 50 cm.

Figure 4C:
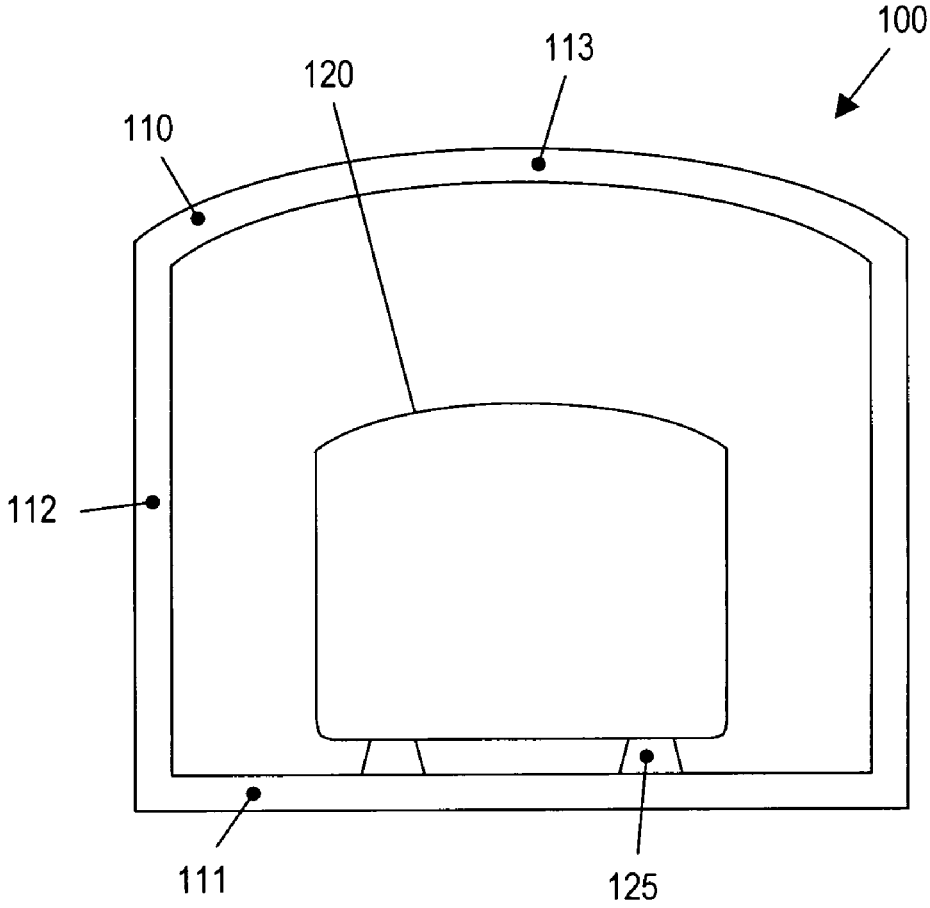

Subsequently, an annular foundation ring and pressure distribution ring is arranged on the thus isolated bottom 111, indicated as ring beam 125, onto which an inner vessel 120 is built (FIG. 4C). Since building said ring beam 125 and inner vessel 120 can take place according to the standard building method, this will not be explained and illustrated here in more detail.

Building a roof 113 of the outer tank 110 can also take place according to a standard building method, and will also not be explained in more detail here.

According to an important aspect of the present invention, a sufficient insulation is now present, both towards the bottom and towards the side wall, and it is not necessary to provide or to improve an insulation by means of perlite grains. More particularly, the space between the inner vessel 120 and the outer vessel 110 can remain empty.

The above-described storage tank 100 is double-walled, i.e. the storage tank comprises an inner vessel 120 and an outer vessel or outer wall 110. Such a storage tank 100 is also indicated as "full containment tank". However, there are also storage tanks which are indicated with the phrase "membrane tank", wherein the function of inner vessel is fulfilled by metal panels attached to the concrete wall of the outer vessel; thus, herein no separate inner vessel is present anymore. Said metal panels must be welded to each other for reaching the necessary liquid-tightness, and must be provided with a complicated profile in order to allow expansion and contraction as result of temperature changes, irrespective of the fixation to the concrete wall. The concept of a storage tank proposed by the present invention is also very well applicable to be applied with a storage tank of this type, wherein then, according to the present invention, the important advantage is offered that the metal panels and their attachment to the concrete can be omitted. Building such a storage tank can take place in a similar manner as discussed in the above, with the understanding that the secondary coating 123 is applied over the full height of the side wall 112. Namely, the secondary coating 123 is itself liquid-tight and gas-tight in a reliable manner, and is resistant to the contact with the cold liquid. Herein it is important that the secondary coating 123 and the underlying PVC-foam have mutually equal or at least comparable thermal expansion coefficients, so that, on changes in temperature as result of filling or emptying the storage tank, mutual stresses do not or hardly occur. Since no separate inner vessel needs to be placed, also the further bottom insulation 124, and also the said ring beam 125, can be left away.

In principle, it is possible to effect applying the coating by hand. However, the present invention proposes a method for applying the coating in an automatic way, especially the secondary coating 123 at the inner surface of the side wall 112. The method proposed by the present invention, which will hereinafter being explained with reference to FIG. 5, offers the important advantage that an automatic quality control is possible, in the sense that it is automatically checked whether the applied coating layer 123 does have the right thickness.

FIG. 5 schematically shows a top view of a part of a side wall 112 with the foam blocks 10 applied thereto. A coating application installation 300 is arranged in the interior of the outer tank 110. The coating application installation 300 comprises a guiding system 301 extending in circumferential direction along the wall 112, and a vehicle 310 displaceable along this guiding system 301. The vehicle further is displaceable in vertical direction, i.e. perpendicular to the plane of drawing. The coating application installation 300 comprises driving means 302 to drive a displacement of the vehicle 310 along the guiding means 301, as well as vertical displacement means 303 to change the vertical position of the vehicle 310 and to hold a vertical position once chosen.

The vehicle 310 is provided with at least one but preferably three arranged above each other, spray nozzle 311 directed substantially horizontal and radially to the inner surface of the wall 112, which is connected, through an insulated hose package 312, to supply vessels 313 for the coating components arranged centrally in the outer tank 110. A feed pump installation not shown for the sake of simplicity pumps the coating components through the insulated hose package 312 to a spray pump 315, and this spray pump pumps the coating components to the spray nozzle 311, where the coating components are mixed and the mixture sprays against the free inner surface of the insulation layer 10. Simultaneously, the horizontal displacement means 302 take care of a horizontal displacement of the vehicle 310 along the wall 112, as indicated with arrow H in FIG. 5. Thus, a track of coating material is applied on the inner surface of the wall 112, indicated at 314 in FIG. 5.

As already mentioned earlier, the coating components react with each other very fast, wherein a monolithic layer is formed. The reaction is completed within about two minutes, and the sprayed substance is strongly viscous, so that the tendency to flow down under the influence of gravity and to thus form drops can be neglected.

An advantage herein is that it is possible to apply the coating 314 in one go at a relatively large thickness, if desired to an order of 1 cm, wherein the achieved thickness of the coating layer 314 depends inter alia on the flow speed of the coating components in the hose package 312, and thus on the pumping power and on the other hand depends on the horizontal displacement speed of the vehicle 310. According to the present invention, an automatic quality control of the applied coating layer 314 becomes possible because the vehicle 310 is provided with a thickness sensor 321 which is adapted to give to a control member 320 a signal which is representative for the thickness of the applied coating layer 314. The coating thickness sensor 321 can for example be a known per se ultrasonic transceiver. The control member 321 controls the coating pump 315 and/or the horizontal displacement means 302 on the basis of the signal received from the thickness sensor 321 such that a coating layer 314 is achieved with a substantially uniform, predetermined thickness. For instance, if on the basis of the signal received from the coating thickness sensor 321 it appears that the coating thickness exceeds a predetermined upper level, the control member 320 can have the horizontal displacement means 302 displace the vehicle 310 faster and/or have the pump 315 pump less coating.

A flow sensor 322 may possibly be incorporated in the house package 312, to give to the control member 320 a signal which is representative for the pump speed.

When the vehicle 310 has traveled a trajectory of 360° along the wall 112, the spray nozzle 311 approaches the back end of the coating layer 314 just deposited, indicated in FIG. 5 at 314A. The coating application installation 300 may be provided with a mechanical reference in order to indicate that the vehicle 310 approaches a wall section where it has already been before. Preferably, however, the vehicle 310 is provided with a camera 330 which is provided with suitable image processing software, in order to recognize that it arrives at the beginning 314A of the coating layer 314 just applied, and which sends a corresponding signal to the control member 320.

As soon as the control member 320 receives a signal which means that the coating layer 314 just applied has been completed over the full 360° of the circumference of the tank wall 112, the control member 320 controls the vertical displacement means 303 in order to bring the vehicle 310 to another vertical level, after which a subsequent coating layer is applied, vertically adjacent to the coating layer 314. Herein it is preferred that the first coating layer 314 is the top coating layer, and that subsequent coating layers are always applied at a lower level.

In principle, it is possible that the vehicle 310 is always displaced along the guiding means 301 in the same direction. However, the hose package 312 which is connected to the fixedly arranged supply tanks 313 may provide a problem. Therefore, always when a new coating layer 314 is started at a new vertical level, the displacement direction of the vehicle 310 along the guiding means 301 is preferably changed, such that the displacement is alternatively left and right.

An advantage of the use of a detection camera 330 in this manner is that the camera image can be displayed on a control monitor, such that operating personnel can visually inspect the quality of the coating layer 314 and of the connections to neighboring coating layers via the monitor image.

Thus, the present invention provides a storage tank 100 with a pre-insulated outer tank 110, and also a method for building such tank. For building a wall 112 of an outer tank 110, a formwork 90 is raised with an inner partition 92 to which PVC-foam plates 10 are attached, which at their inner surface 2 are provided with a coating 3 provided with gravel 4. Subsequently, concrete 94 is poured into the formwork inner space 93, which concrete attaches firmly to the gravel sticking out of the coating.

A coating layer 121 is applied on a floor 111, over which a layer of PVC-foam plates 122 is applied. Subsequently, a secondary monolithic coating layer 123 is sprayed over those PVC-foam plates 122 and on the inner surface of the coated PVC-plates 10 of the wall 112.

It will be clear to a person skilled in the art that the scope of the present invention is not limited to the examples discussed in the above, but that several amendment and modifications thereof are possible without departing from the scope of the invention as defined in the attached claims.

The invention claimed is:

1. Storage tank, meant for storing cold liquids, comprising a concrete wall which at its inner side is provided with an insulation layer of PVC-foam and a coating provided with gravel between the PVC-foam and the concrete wall wherein the coating is liquid-tight and vapor-tight.

2. Storage rank according to claim 1, wherein the PVC-foam has an expansion coefficient and the coating has an expansion coefficient which is substantially equal to or comparable with the expansion coefficient of the PVC-foam.

3. Storage tank according to claim 1, further comprising a concrete floor with a coating layer thereon and a layer of PVC-foam applied thereon.

4. Storage rank according to claim 3, wherein the coating layer of the concrete floor and the coating layer of the concrete wall are comprised of substantially equal materials.

5. Storage tank according to claim 3, further comprising a secondary monolithic coating layer on the top surface of said layer of PVC-foam on the concrete floor and on the inner surface of the said layer of PVC-foam of the concrete wall.

6. Storage tank according to claim 5, wherein the secondary monolithic coating layer extends over substantially the full height of the concrete wall.

7. Storage rank according to claim 5, provided with an inner tank, wherein the height of the secondary monolithic coating layer on the inner surface of the said layer of PVC-foam of the concrete wall corresponds to the volume of said inner tank.

8. Storage tank, meant for storing cold liquids, comprising a concrete wall and a concrete floor;

a wall coating layer applied on the inner side of the concrete wall;

a floor coating layer applied on the upper side of the concrete floor;

a wall insulation layer of PVC-foam on the inner side of the wall coating layer;

a floor insulation layer of PVC-foam applied on the floor coating layer;

a secondary monolithic coating layer on the top surface of said floor insulation layer of PVC-foam and on the inner surface of said wall insulation layer of PVC-foam, wherein the floor coating layer and the wall coating layer are liquid-tight and vapor-tight.

9. Storage tank according to claim 8, wherein the wall coating layer has an expansion coefficient which is substantially equal to or comparable with the expansion coefficient of the wall insulation layer of PVC-foam.

10. Storage tank according to claim 8, wherein the floor coating layer and the wall coating layer are comprised of substantially equal materials.

11. Storage tank according to claim 8, wherein the secondary monolithic coating layer extends over substantially the full height of the concrete wall.

12. Storage tank according to claim 8, provided with an inner tank, wherein the height of the secondary monolithic coating layer on the inner surface of the said layer of PVC-foam of the concrete wall corresponds to the volume of said inner tank.

13. Storage tank according to claim 8, wherein the wall coating layer is provided with gravel.

* * * * *